US007052159B2

(12) United States Patent
Wu

(10) Patent No.: US 7,052,159 B2
(45) Date of Patent: May 30, 2006

(54) LARGE GROUP OF DECORATION LIGHT STRING

(76) Inventor: Jeng-Shyong Wu, No. 14, Alley 1, Lane 326, Shyr-Piin Road, Hsin-Chu City (TW)

( * ) Notice: Subject to any disclaimer, the term of this patent is extended or adjusted under 35 U.S.C. 154(b) by 159 days.

(21) Appl. No.: 10/348,096

(22) Filed: Jan. 21, 2003

(65) Prior Publication Data

US 2003/0137841 A1 Jul. 24, 2003

(30) Foreign Application Priority Data

Jan. 21, 2002 (CN) ..... 02 2 01687

(51) Int. Cl.
*F21S 13/14* (2006.01)

(52) U.S. Cl. ..... 362/252; 362/808; 362/800; 362/391

(58) Field of Classification Search ..... 362/252, 362/806, 800, 227, 391, 251, 808; 40/442, 40/452, 540, 541, 550
See application file for complete search history.

(56) References Cited

U.S. PATENT DOCUMENTS

| | | | | |
|---|---|---|---|---|
| 5,379,202 | A * | 1/1995 | Daun | 362/252 |
| 5,561,346 | A * | 10/1996 | Byrne | 313/512 |
| 6,550,950 | B1 * | 4/2003 | Fernandez | 362/545 |
| 2002/0141184 | A1 * | 10/2002 | Shieh | 362/252 |

* cited by examiner

*Primary Examiner*—Sandra O'Shea
*Assistant Examiner*—Sharon Payne
(74) *Attorney, Agent, or Firm*—Buckman and Archer; Joseph J. Orlando

(57) ABSTRACT

There is provided a decoration light string generally using multiple luminaries connected with multiple electrical conductors with serial, parallel or serial and parallel circuit loops into sub-groups of decoration light strings. Thereafter, multiple sub-groups of decoration light strings are formed into a main group of decoration light string. The multiple sub-group decoration light strings flash randomly or orderly via a control device thus establishing motive style.

25 Claims, 12 Drawing Sheets

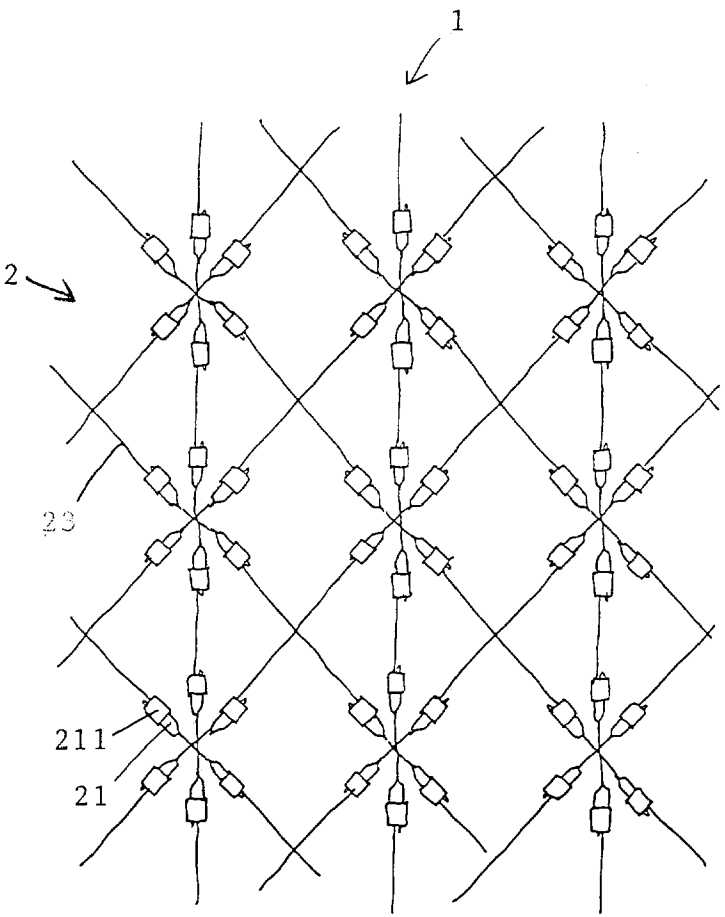
FIG. 1B
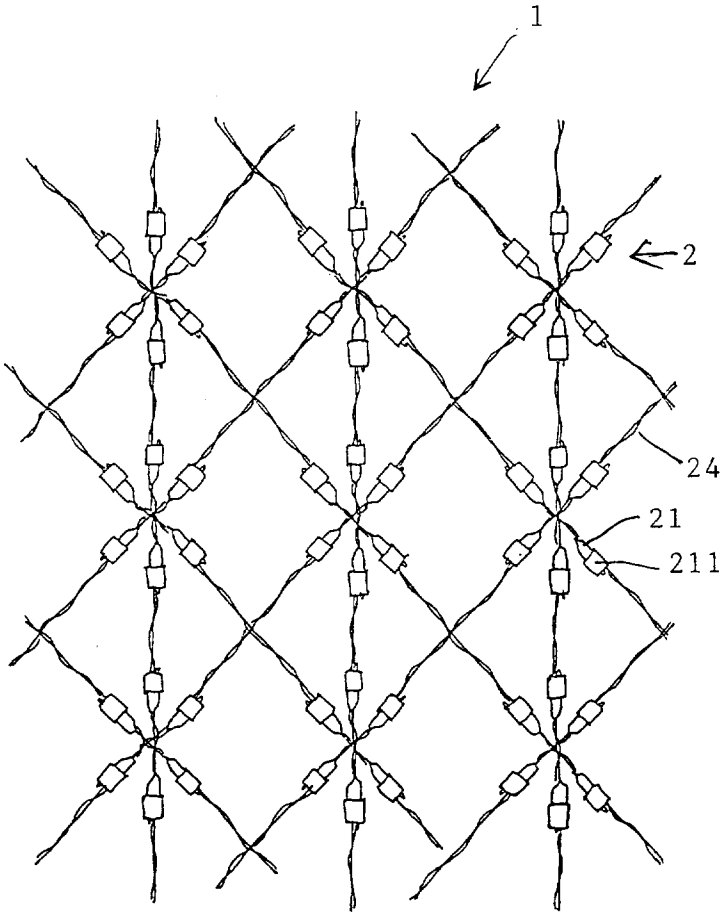
FIG. 1A
FIG. 1

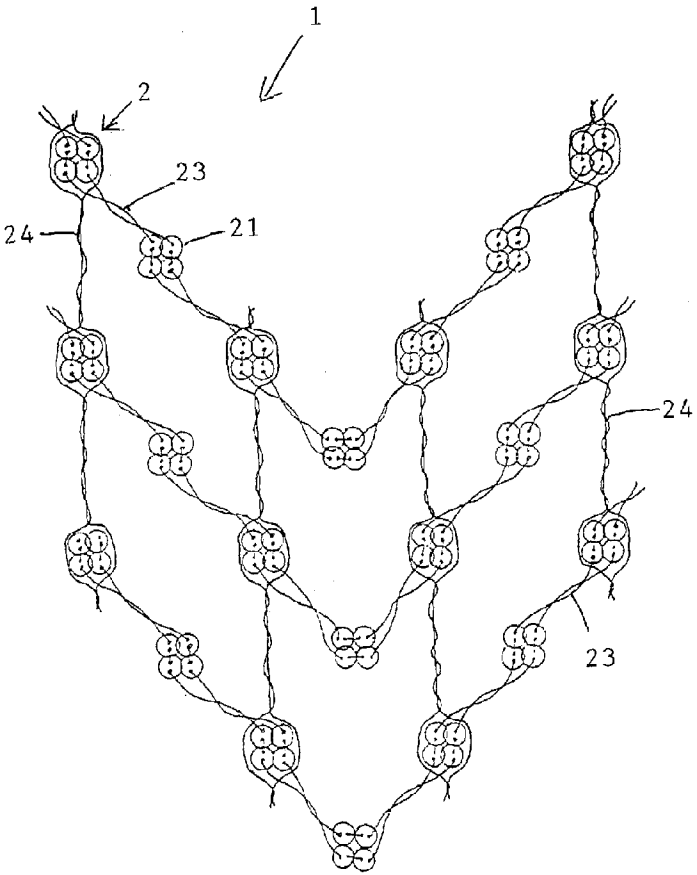
FIG. 2B
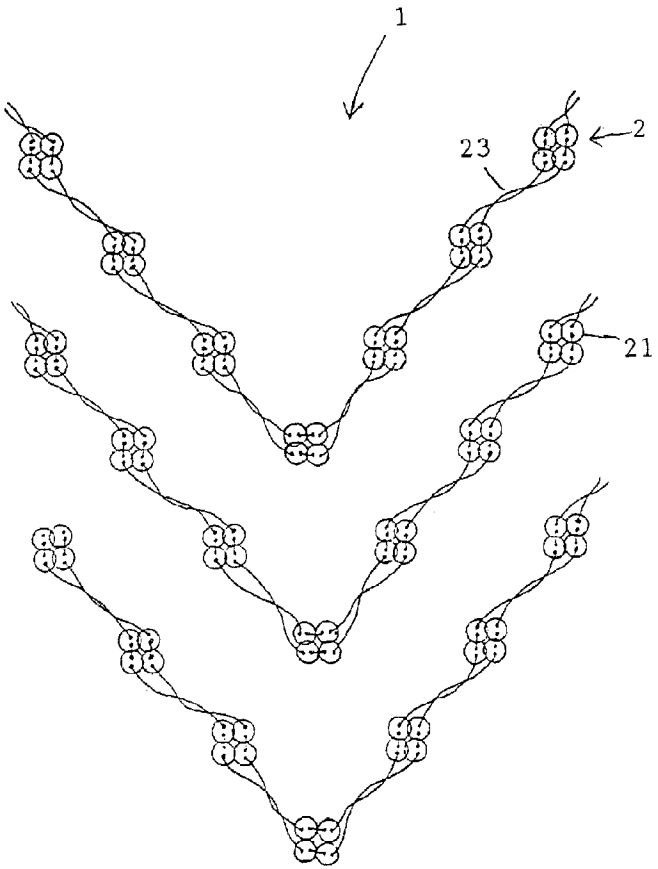
FIG. 2A
FIG. 2

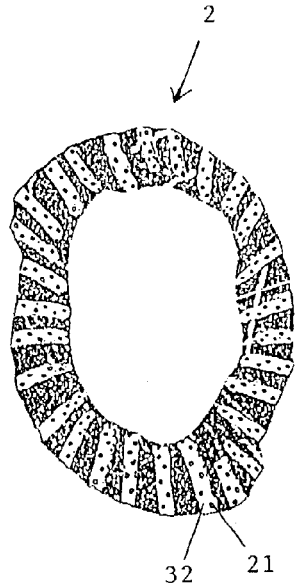
FIG.3A
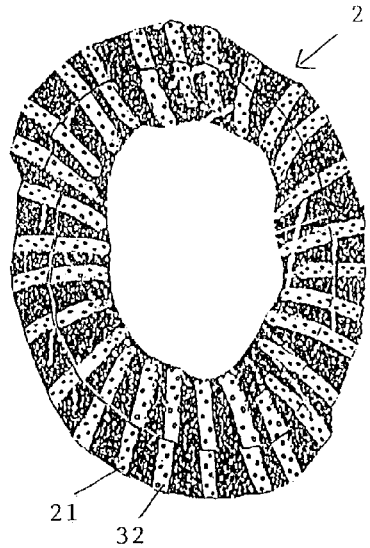
FIG.3B
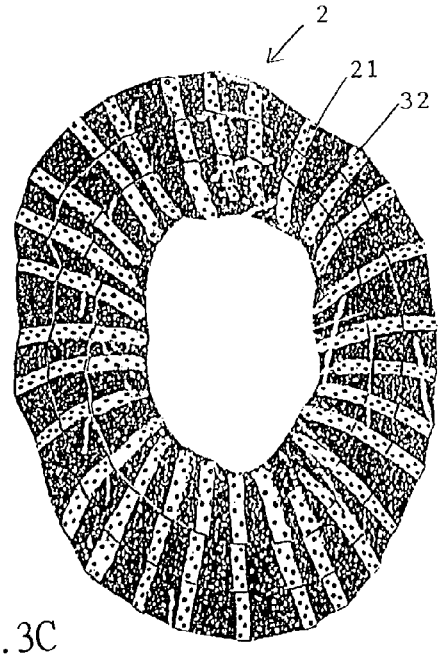
FIG.3C
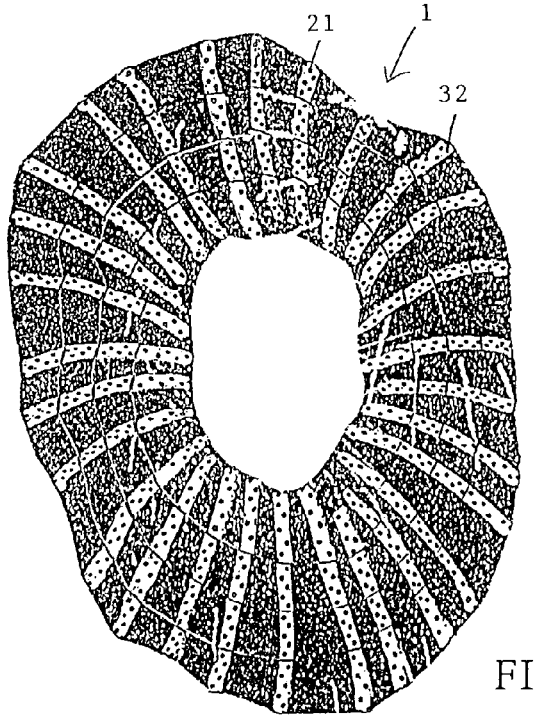
FIG.3D
FIG.3

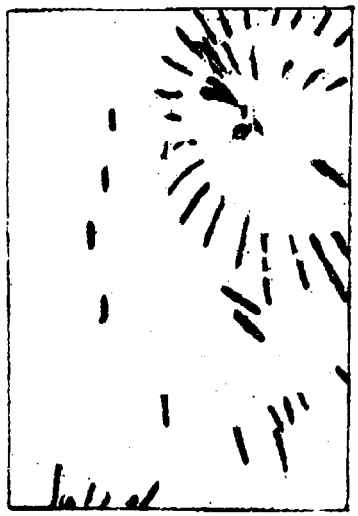
FIG.4E
FIG.4C
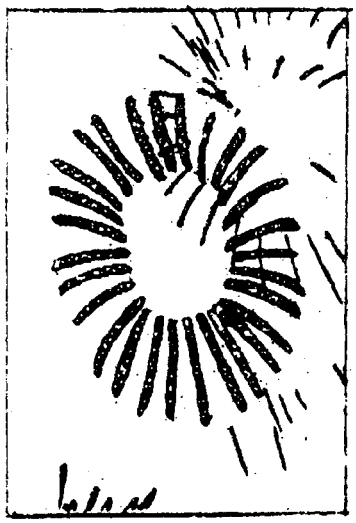
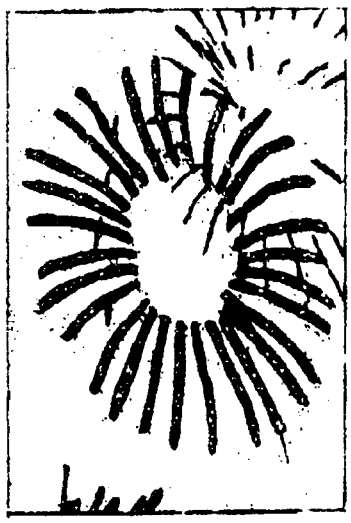
FIG.4D
FIG.4A
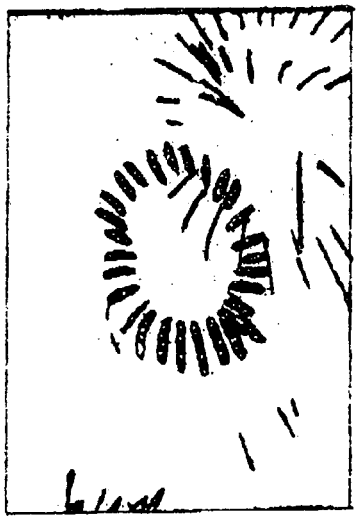
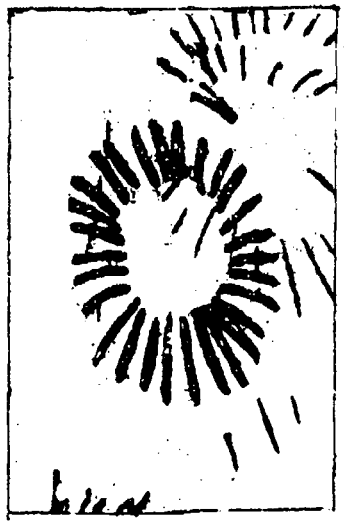
FIG.4B
FIG.4

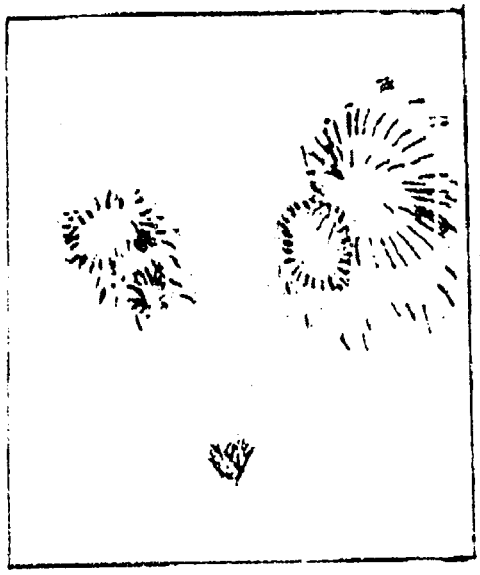
STEP 1
FIG. 5A
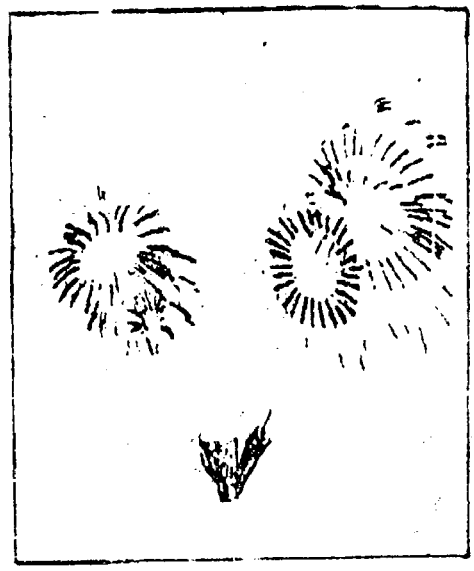
STEP 2
FIG. 5B
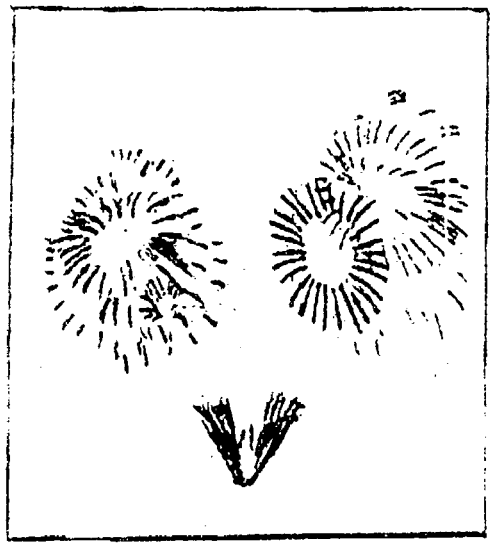
STEP 3
FIG. 5C
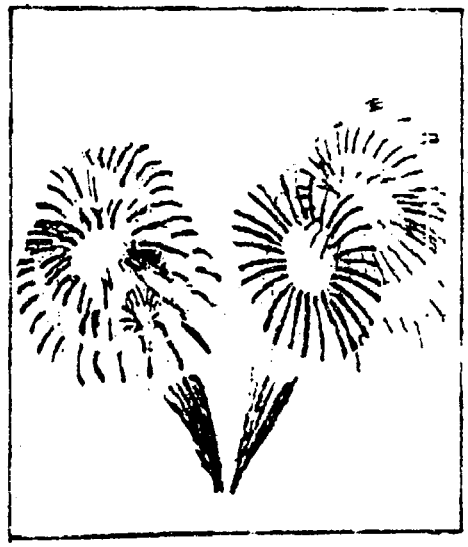
STEP 4
FIG. 5D
FIG. 5

LARGE GROUP OF DECORATION LIGHT STRING

BACKGROUND OF THE INVENTION

The present invention generally relates to a decoration light string, more particularly, it relates to comprising multiple sub-group decoration light strings into a main group decoration light string. By means of controlling the luminaries in the sub-group decoration light strings so as to flash randomly or orderly, it is possible to produce an obviously repeating motion style.

Light decoration has an artistic result, especially in the evening or in dark places including indoor and outdoor. By means of light itself and decoration, designed style and patterns, such decoration will cause noticeable results. At light decoration moment, the states of expression can be both stationary and motive. The motive state is by means of flashing the luminaries or carrying luminaries mechanically to let the light decoration string appear motive. Generally speaking, the motive light decoration style is more attractive than the stationary light decoration. However, the motive light decoration is still not diversified and the manufacturing costs are high. Furthermore, such decorations require large scale to be shown properly, such as in a large square or plaza. The motive simulation results are still not very good and the decorations will face destruction and discard after exhibition.

SUMMARY OF THE INVENTION

In order to increase motive light decoration results and multiple variations, even the little group can contribute to the obvious result. Thus, the present invention provides a large or main group decoration light string, comprising many smaller group decoration light strings. Each smaller group decoration light string comprises multiple luminaries being connected with multiple electrical conductors in series, parallel and series and parallel. By controlling the orderly flashing of the lights in the smaller group decoration light strings, the large group decoration light string appears in motive style, such as the orderly repeating of fireworks or a space shuttle take off.

The present invention provides a decoration light string, comprising luminaries connected by the power connector via serial, parallel or serial and parallel circuit loops into sub-groups of decoration light strings. These multiple sub-groups of decoration light strings are then arranged to establish a main group of decoration light string.

Another object of the present invention is to provide a decoration light string comprising luminaries connected by the power connector via serial, parallel or serial and parallel circuit loops into sub-groups of decoration light strings which are arranged to establish a main group of decoration light string. The multiple sub-group decoration light strings flash randomly or orderly via a control device to thus establish motive style.

BRIEF DESCRIPTION OF THE DRAWINGS

FIG. 1 is a perspective view of the first embodiment of the present invention showing luminaries being connected into a network style with electrical conductors or non-electrical connectors.

FIG. 2 is a perspective view of the second embodiment of the present invention showing luminaries being connected into a network or connected style with electrical conductor or non-electrical connectors;

FIG. 3 is a perspective view of another embodiment of the present invention showing doughnut shapes of sub-group decoration light string and main group decoration light string;

FIG. 4 is a perspective view of another embodiment of the present invention;

FIG. 5 is a perspective view of a further embodiment of the present invention;

DESCRIPTION OF PREFERRED EMBODIMENTS

Figure 6:
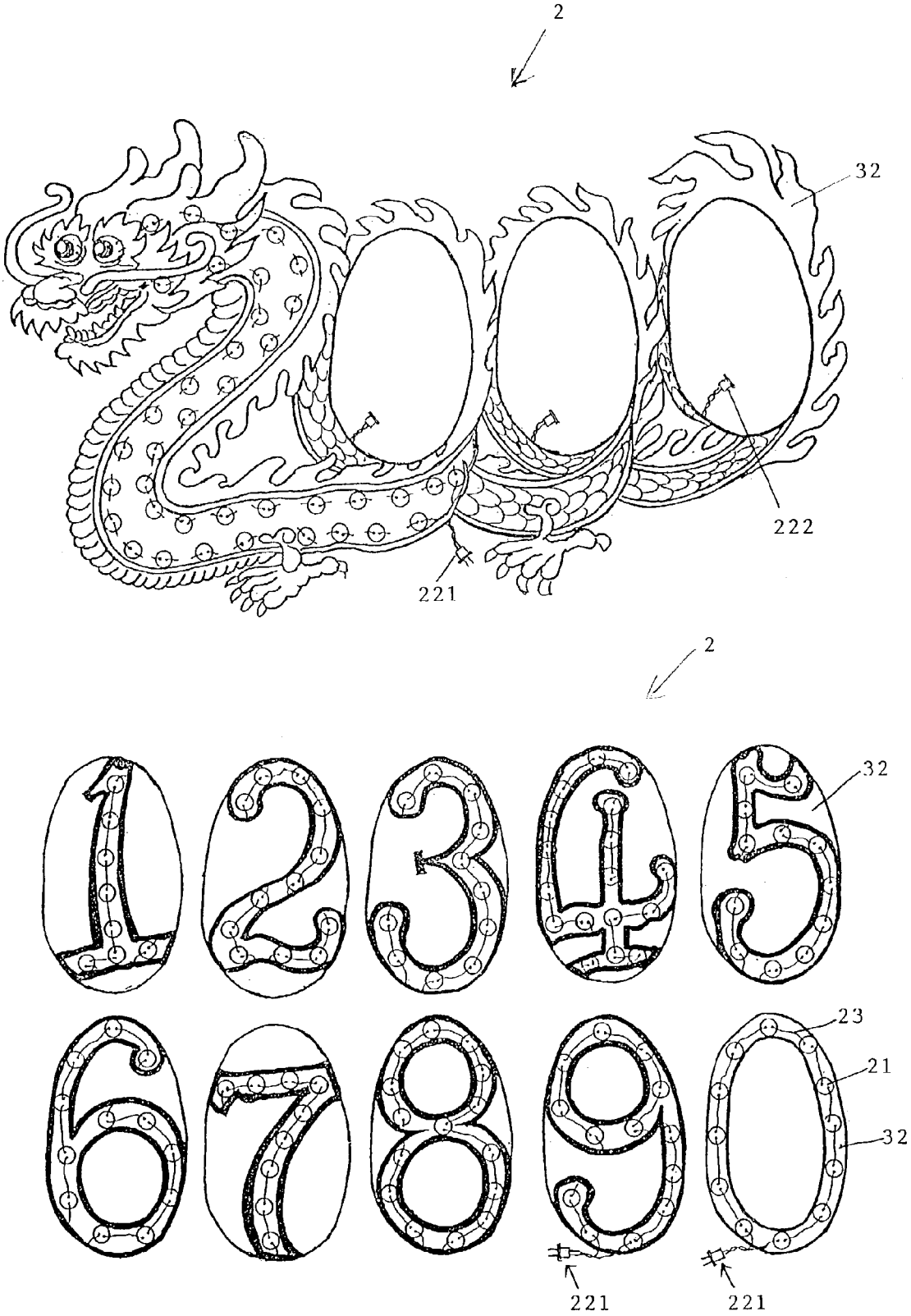
FIG. 6 is a perspective view of a further embodiment of the present invention.

The above mentioned luminaries are connected with multiple electrical conductors by using the non-electrical connectors twisted with electrical conductors to enhance the connection. The luminaries can be vacuum bulb, filling air bulb and LED attached to the lamp base and lamp holder. The power connector can be a single or multiple power socket or tail connected mutually. The luminaries are connected with electrical conductors, non-electrical connectors, fixed device or mutually twisted to establish a sub-group decoration light string. The luminaries, lamp bases or electrical conductors are fixed by the fixed device, a supporting frame or film, to establish a plane or three dimensional sub-group decoration light string. The sub-group decoration light strings are connected with electrical conductors, non-electrical connectors or fixed device to form and establish a main group decoration light string. The sub-group decoration light strings can be separated, overlapping or contain one or the other to form a plane or three dimensional main group decoration light string. A main group decoration light string uses the same or different scale of sub-group decoration light strings. The main group decoration light string uses many sub-group decoration light strings to adjust its frame space or distance apart from one to the other so as to have a changeable shape.

Further, a main group decoration light string can use a control device to make many sub-group decoration light strings flash. Starting from the first group decoration light string flashing, then after a certain period of time, the second group decoration light string flashes and then, after a certain period of time, the third group decoration light string flashes and so on. All group decoration light strings will die out simultaneously when all the groups of light are done. Then the flashing is repeated so that it appears like fireworks. A main group decoration light string uses a control device to make the luminaries of many sub-group decoration light strings light up by on-off means, and speed adjustment so that a sense of motion appears. Visually, the sub-group decoration light string appears as a straight line, or it is extended to a round shape or a random motional shape. A main group decoration light string uses the control device to control the luminaries in many sub-group decoration light strings simultaneously, fully or partially, so that the luminaries flash synchronously to either fully or partially brighten up or die out. Said control device can be either a manual or automatic start or weight device, which allows luminaries to start and operate manually or automatically. This operation transmits the data to the signal processor via either infrared or radio frequency.

Now referring to FIG. 1 including FIGS. 1A and 1B, luminaries 21 via electrical conductor 23 or non-electrical connector 24 are connected into a network style. One end of the luminaries 21 is fixed on the lamp holder 211. In these drawings, six luminaries 21 form a sub-group decoration light string 2, then by means of the connection of electrical conductors 23 and non-electrical connectors 24 they form a main group decoration light string 1. The non-electrical connector 24 can be metal string, non-metal string or combination of both, but its use is not that of a conductor. A non-metal string can be such as plastic string.

Referring to FIG. 2 including FIGS. 2A and 2B, four luminaries 21 become a sub-group decoration light string 2, every sub-group decoration light string 2 then by means of the connection of electrical conductors 23 and non-electrical connectors 24 forms a main group decoration light string 1. FIG. 2A shows a "V" shape, and FIG. 2B shows a "V" network shape.

Referring to FIG. 3 including FIGS. 3A, 3B, 3C and 3D, wherein FIG. 3A shows an embodiment of a sub-group decoration light string 2 of the present invention. The sub-group decoration light string 2 includes a round shape supporting face (black part as shown), every luminary 21 being fixed on a wire 32, many wires 32 appearing to radiate a fixed shape on the round shape supporting face. FIG. 3B shows two different diameters of sub-group decoration light string 2 like FIG. 3A. The outer diameter of one sub-group decoration light string is equal to the inner diameter of the other sub-group decoration light string which are mutual to each other. FIG. 3C shows three different diameters to show the combination of three sub-group decoration light strings 2. FIG. 3D shows four different diameters to show the combination of four sub-group decoration light strings 2. By means of controlling the orderly flashing of the four sub-group decoration light strings 2, the appearance of a motional effect can be given.

Referring to FIG. 4 including FIGS. 4A, 4B, 4C, 4D and 4E, there is shown embodiment of FIG. 3 showing a main group decoration light string 1 used as fireworks shapes. In order to obtain a better display, every main group decoration light string 1 may include four or more sub-group decoration light strings 21. For example, during operation, from the direction of the inner to outer circle in accordance with on-off time flashing of sub-group decoration light strings 21, a fireworks effect is thus obtained. In a better way, the use of different color luminaries 21 gives a diversified effect.

Referring to FIG. 5 including FIGS. 5A, 5B, 5C and 5D, a further embodiment of FIG. 4 shows a main group decoration light string 1. The two main group decoration light strings 1 plus a light bundle are formed into a whole body. Thus, by means of the control of light bundle and orderly flashing of the sub-group decoration light strings 2 inside the main group decoration light strings 1, a perfect firework effect appears.

Referring to FIG. 6 including upper and lower drawings, the lower drawing shows numerical numbers in each sub-group decoration light string 2. These numerical numbers are fixed on the ellipse board 32. The edge of ellipse board 32 has an electric plug 221. The upper drawing shows a dragon shape decoration light string, there are three ellipse frames on the back of this dragon body for three numerical number ellipse boards 32 thus to establish a main group decoration light string. There is a plug 222 (female plug) inside each ellipse board provided to connect to the plug 221 (male plug) in each ellipse board 32, also there are luminaries 21 on the side of the dragon body. Similarly, the orderly on-off flashing of sub-group decoration light string 2 can be controlled to thus produce an attractive result.

Figure 7:
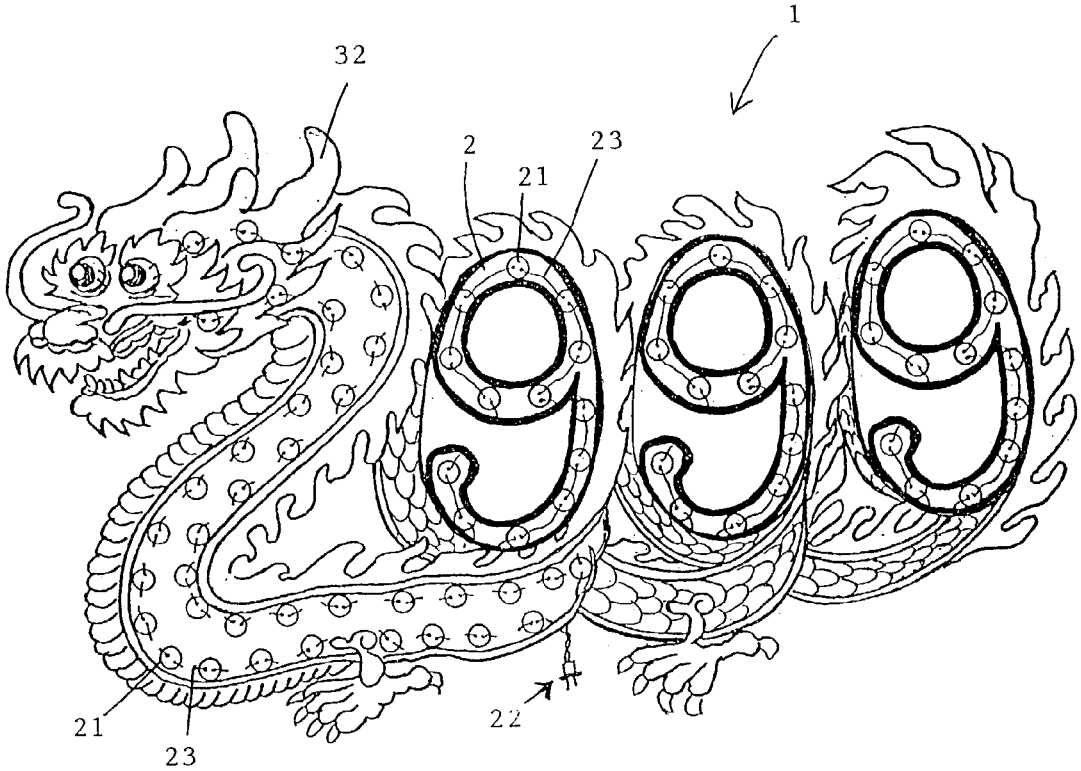
FIG. 7 is a perspective view of a further embodiment of the present invention.
Figure 7:
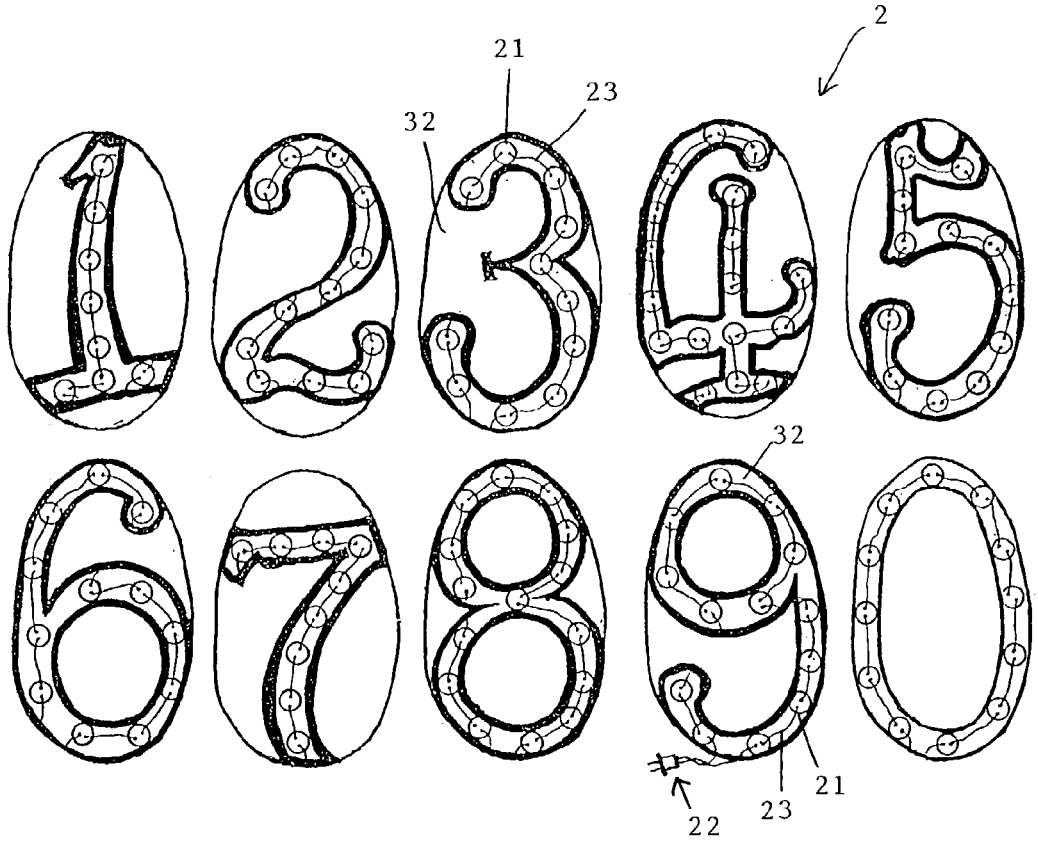

Referring to FIG. 7 including the upper and lower drawings, the lower drawing is similar in the lower drawing in FIG. 6, but the upper drawing has already installed numerical number ellipse board 32, thus it is a sub-group decoration light string 2.

Figure 8:
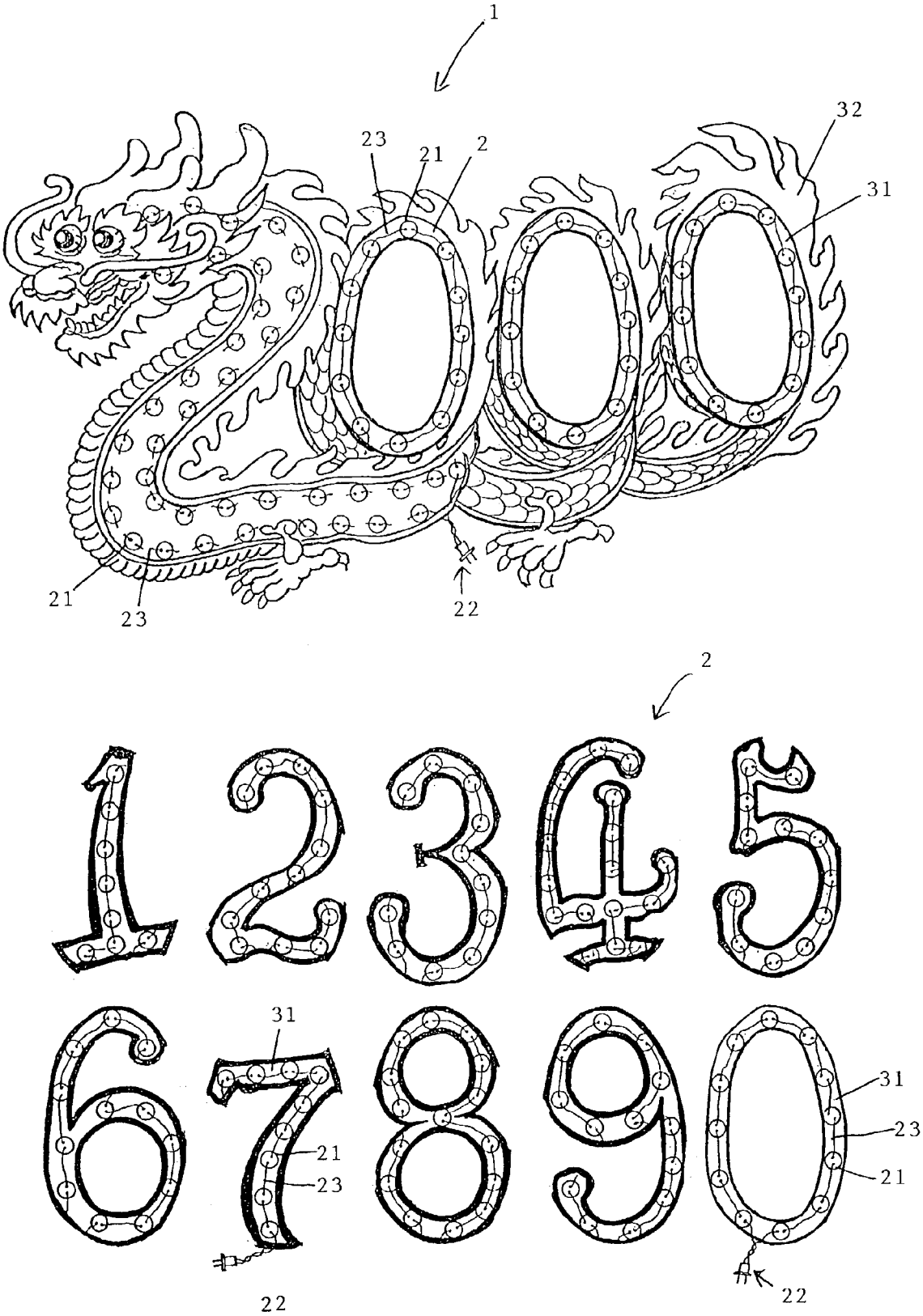
FIG. 8 is a perspective view of a further embodiment of the present invention.
Figure 9:
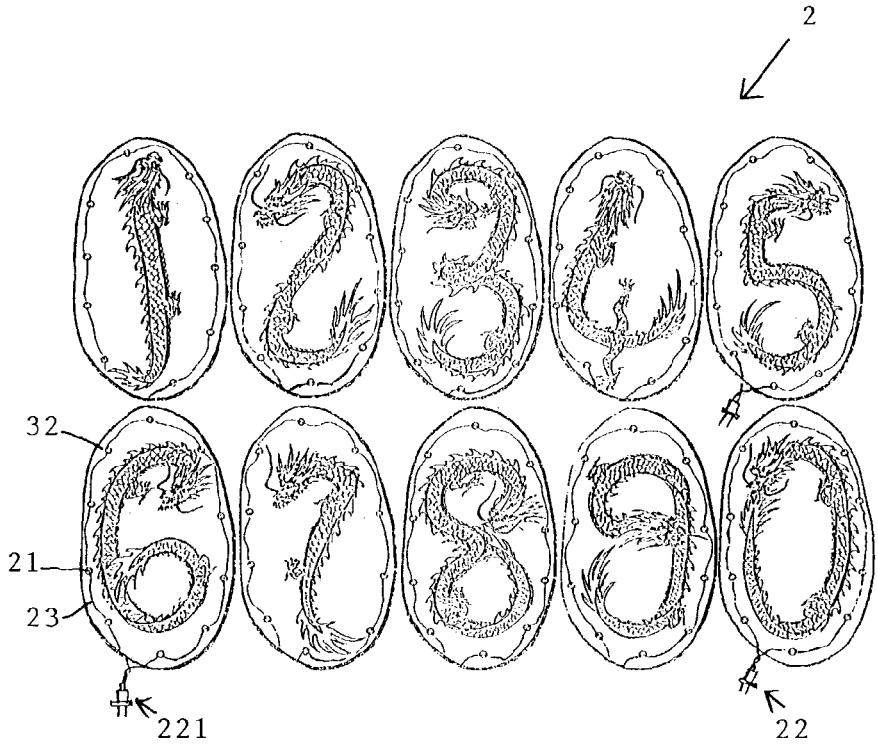
FIG. 9 is a perspective view of a further embodiment of the present invention.
Figure 9:
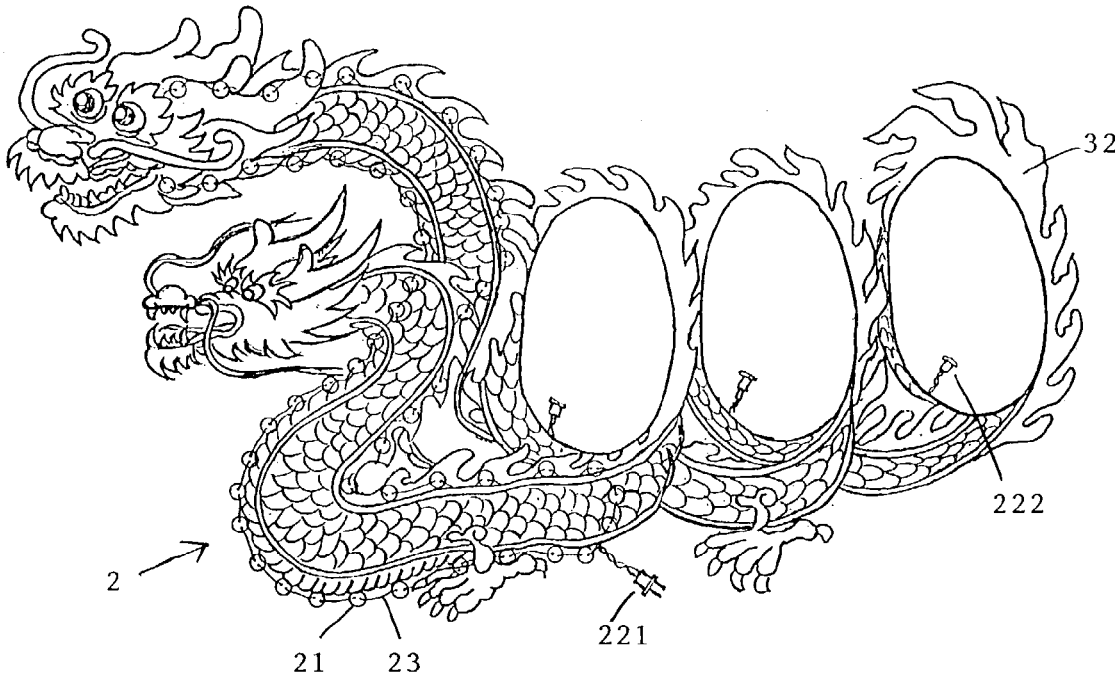
Figure 10:
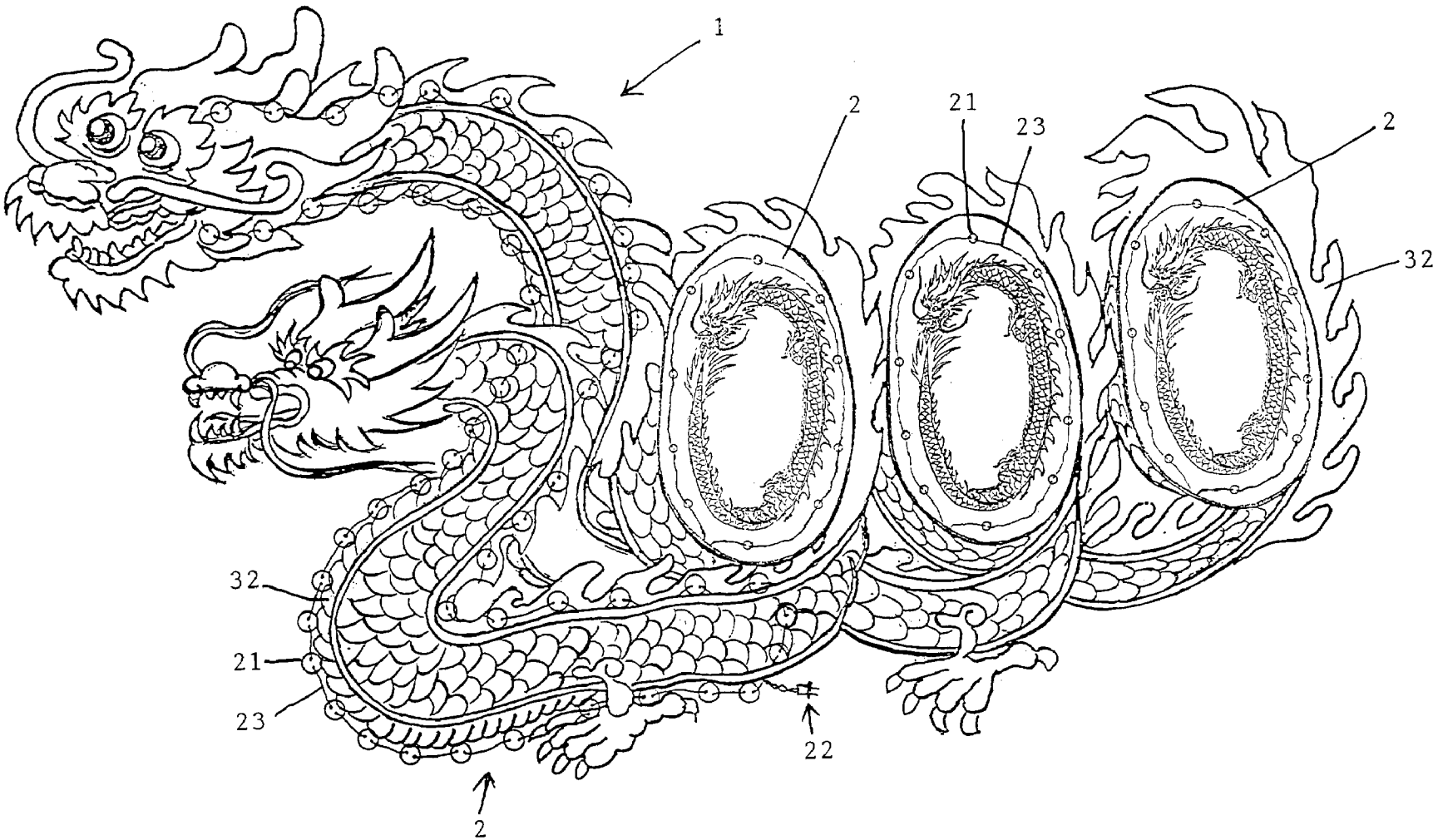
FIG. 10 is a perspective view of a further embodiment of the present invention.

Referring to FIGS. 8, 9 and 10, these are similar to FIG. 7 in which the appearances are presented in different style.

Figure 11:
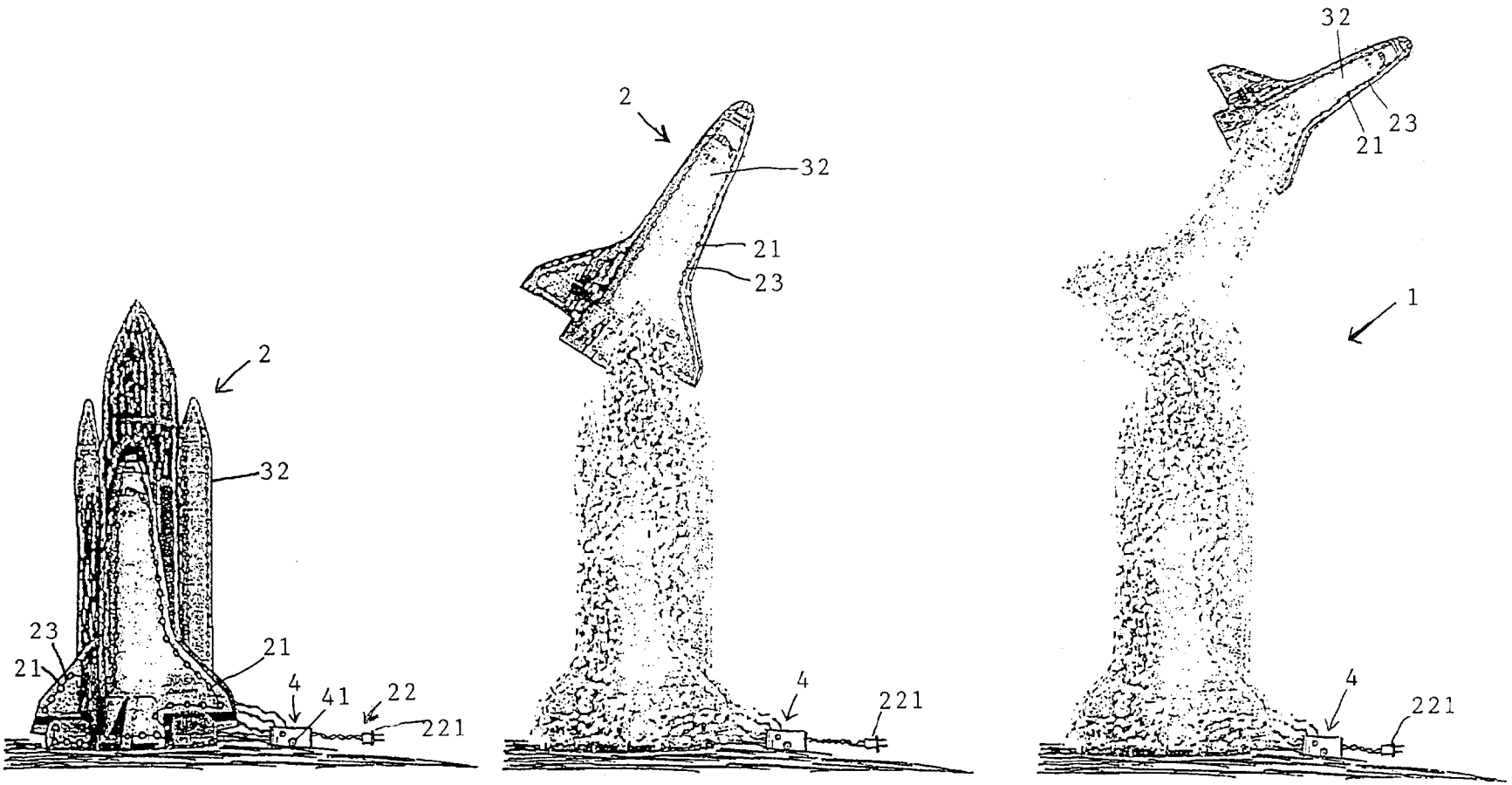
FIG. 11 is a perspective view of a further embodiment of the present invention.

Referring to FIG. 11, it shows a perspective view of a main group decoration light string, in the appearance of a space shuttle shape. It shows the space shuttle 2 not yet taking off in the left drawing. In the bottom of the space shuttle 2, there are a control device 4, starting device, weight device 41, power connecter 22 and so on. The middle drawing shows the status of space shuttle 2 taking off and including the pattern of a torch shape. The right drawing shows the space shuttle 2 beyond take off. By means of the control device to control the flashing sequence in each sub-group decoration light string 2, the result of motional status can be presented with the space shuttle 2 taking off.

Figure 12:
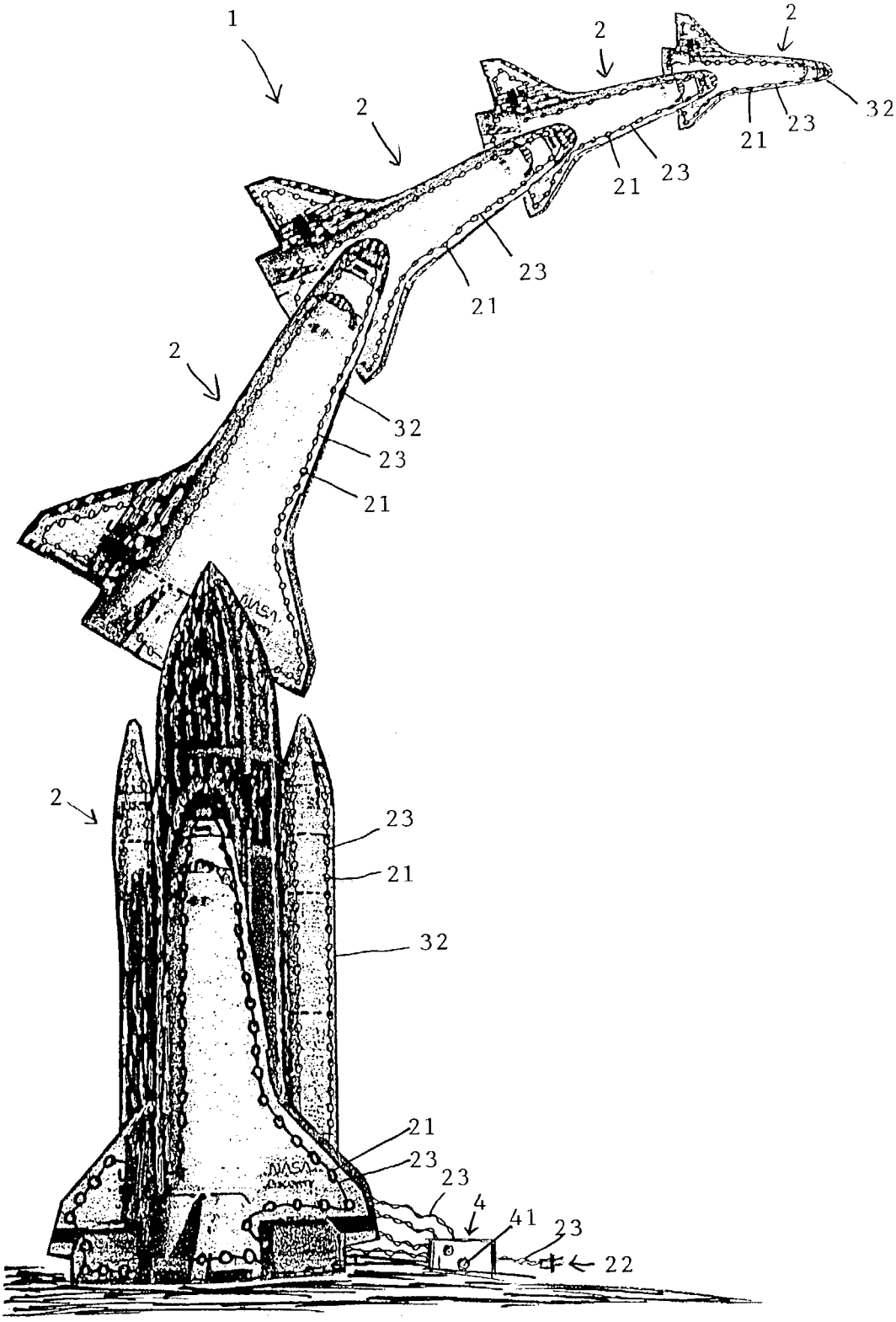
FIG. 12 is a perspective view of a further embodiment of the present invention.

Referring to FIG. 12, it shows a perspective view of a main group decoration light string, in the form of a space shuttle shape. This main group decoration's light string is made up of different height of space shuttles 2, i.e. sub-group decoration light strings 2, connecting them to form the main group decoration light string 1. By means of the control device to control the flashing sequence in each space shuttle 2, which thus performs in a different way than FIG. 11 to present the notional status result of the space shuttle 2 taking off.

The features and preferred embodiments of the present invention have been described in the foregoing specification. The invention intended to be protected herein, however, is not to be construed as limited to the particular forms disclosed. Variations and changes, which may be made by those skilled in the art, are covered without departing from the scope of the present invention.

I claim:

1. A main group of decoration light strings comprising multiple luminaries connected with multiple electrical conductors in series, parallel and mixtures of series and parallel to form a loop of a sub-group of decoration light strings, a plurality of sub-group of decoration light strings forming said main group of decoration light strings, and non-electrical connectors twisted with said electrical conductors so as to reinforce the connections thereof.

2. The main group of decoration light strings as defined in claim 1, wherein the luminaries are vacuum bulbs, or air filled bulbs, or LEDs installed in a lamp base and a lamp holder.

3. The main group of decoration light strings as defined in claim 1, which further includes a plurality of power connectors having single or multiple power sockets or tail connectors mutually connected.

4. The main group of decoration light strings as defined in claim 1, wherein said luminaries connected with electrical conductors and non-electrical connectors forming a sub-group of decoration light strings are connected to a fixed device or mutually twisted to form said sub-group of decoration light strings.

5. The main group of decoration light strings as defined in claim 4, wherein the luminaries connected to said fixed device or mutually twisted form a plane or a three dimensional sub-group of decoration light strings.

6. The main group of decoration light strings as defined in claim 1, wherein said plurality of sub-group of decoration light strings are separated one from the other, or overlapping or including one or another forming a plane or a three dimensional main group of decoration light strings.

7. The main group of decoration light strings as defined in claim 1, wherein each sub-group of decoration light strings is comprised of the same scale.

8. The main group of decoration strings string as defined in claim 1, wherein each sub-group of decoration light strings is comprised of a different scale.

9. The main group decoration light strings as defined in claim 1, wherein each sub-group of decoration light strings is comprised of the same shape.

10. The main group of decoration light strings as defined in claim 1, wherein each sub-group of decoration light strings is comprised of a different shape.

11. A main group of decoration light strings comprising multiple luminaries connected with multiple electrical conductors in series, parallel and mixtures of series and parallel to form a loop of a sub-group of decoration light strings, a plurality of sub-group of decoration light strings forming said main group of decoration light strings, a control device for controlling the brightness and random or orderly flashing of the main group of decoration light strings so as to establish a movement trend, and non-electrical connectors twisted with said electrical conductors so as to reinforce the connections thereof.

12. The main group of decoration light strings as defined in claim 11, wherein the luminaries are vacuum bulbs, or air filled bulbs, or LEDs installed in a lamp base and a lamp holder.

13. The main group of decoration light strings as defined in claim 11, which further includes a plurality of power connectors having single or multiple power sockets or tail connectors mutually connected.

14. The main group of decoration light strings as defined in claim 11, wherein said luminaries connected with electrical conductors and non-electrical connectors forming a sub-group of decoration light strings are connected to a fixed device or mutually twisted to form said sub-group of decoration light strings.

15. The main group of decoration light strings as defined in claim 14, wherein the luminaries connected to said fixed device or mutually twisted form a plane or a three dimensional sub-group of decoration light strings.

16. The main group of decoration light strings as defined in claim 11, wherein said plurality of sub-group of decoration light strings are separated one from the other, or overlapping or including one or another forming a plane or a three dimensional main group of decoration light strings.

17. The main group of decoration light strings as defined in claim 11, wherein each sub-group of decoration light strings is comprised of the same scale.

18. The main group of decoration light strings as defined in claim 11, wherein each sub-group of decoration light strings is comprised of a different scale.

19. The main group decoration light strings as defined in claim 11, wherein each sub-group of decoration light strings is comprised of the same shape.

20. The main group of decoration light strings as defined in claim 11, wherein each sub-group of decoration light strings is comprised of a different shape.

21. The main group of decoration light strings as defined in claim 11, wherein said control device controls said plurality of sub-group of decoration light strings to cause their luminaries to flash or change brightness at the same time or at different times.

22. The main group of decoration light strings as defined in claim 11, wherein said control device controls the flashing of the luminaries in each sub-group of decoration light strings so that the flashing of sub-group of decoration light strings are sequential until all sub-group of decoration light strings have flashed, then the sequential flashing is repeated.

23. The main group of decoration light strings as defined in claim 11, wherein said control device controls the on-off and speed adjustment of the luminaries in the plurality of sub-group of decoration light strings so that visually motion appears in a straight line, or round shape or randomly.

24. The main group of decoration light strings as defined in claim 11, wherein said control device controls the luminaries in the plurality of sub-group decoration light strings simultaneously or partially simultaneously, so that the luminaries flash fully or partially to be synchronously bright or dying out.

25. The main group decoration light strings as defined in claim 24, wherein said control device manually or automatically starts the luminaries, and a signal processor receives this data by either Infrared or Radio Frequency.

* * * * *